US005734218A

United States Patent [19]

Crockett et al.

[11] Patent Number: 5,734,218

[45] Date of Patent: Mar. 31, 1998

[54] ELECTRICAL SLIP RING AND METHOD OF MANUFACTURING SAME

[75] Inventors: Russell L. Crockett, Christiansburg; Don Grissom, Blacksburg; Wayne McCoy, McCoy; Glenn Lawson, Blacksburg, all of Va.

[73] Assignee: Litton Systems, Inc., Woodland Hill, Calif.

[21] Appl. No.: 645,221

[22] Filed: May 13, 1996

[51] Int. Cl.[6] ..... H01R 39/08

[52] U.S. Cl. ..... 310/232; 29/597

[58] Field of Search ..... 310/232, 235, 310/42, 43; 29/596, 597, 598

[56] References Cited

U.S. PATENT DOCUMENTS

| | | | |
|---|---|---|---|
| 2,934,815 | 5/1960 | Stumbock | 310/232 |
| 3,042,998 | 7/1962 | Sweett et al. | 310/232 |
| 3,253,325 | 5/1966 | Slack | 310/232 |
| 3,785,049 | 1/1974 | Kanamaru et al. | 29/629 |
| 4,535,264 | 8/1985 | Allport | 310/232 |
| 4,645,962 | 2/1987 | Freeman | 310/232 |
| 4,684,179 | 8/1987 | Freeman | 439/27 |
| 4,782,580 | 11/1988 | Cacioppo et al. | 29/597 |
| 4,837,920 | 6/1989 | Sweet et al. | 29/597 |
| 4,871,935 | 10/1989 | Sweet et al. | 310/232 |
| 5,054,189 | 10/1991 | Bowman et al. | 29/597 |
| 5,177,858 | 1/1993 | Jones | 29/596 |
| 5,327,037 | 7/1994 | Rasmussen | 310/232 |
| 5,459,364 | 10/1995 | Rondier | 310/232 |
| 5,521,450 | 5/1996 | Rondier | 310/232 |

*Primary Examiner*—Clayton E. LaBalle
*Assistant Examiner*—Michael J. Wallace, Jr.
*Attorney, Agent, or Firm*—Gerald L. Lett

[57] ABSTRACT

A slip ring base assembly utilizing a novel construction and manufacturing technique uses a molded or extruded base profile that can be manufactured in various shapes and configurations and is flexible enough to conform to many diameters. A rigid backing is provided, as may be a suitable hub, for stiffening and reinforcing the base profile. Strip or round conducting rings whose surface may be flat, grooved or channeled, are inserted on the base member.

9 Claims, 4 Drawing Sheets

ELECTRICAL SLIP RING AND METHOD OF MANUFACTURING SAME

BACKGROUND OF THE INVENTION

This invention relates to an electrical slip ring assembly, more particularly, the base portion of the electrical slip ring and a method of manufacturing same.

Electrical slip rings are now well known devices for communicating electrical signals from one structural member to another where one of the structural members is rotatable with respect to the other. Such a slip ring assembly, for example, may comprise a relatively rotatable annular base member which has a plurality of conductive rings extending around an outer circumferential face thereof. A series of electrically conductive brushes is arranged on a relatively stationary structural member to make electrical contact with the aforementioned conductive rings thereby forming a series of electrical connections between the two structural members. Of course, conversely, the base member may be stationary and the brushes may be relatively rotatable.

Heretofore, the base assemblies for the slip rings have been generally constructed in such a fashion that the conductive rings are molded therein as a part of the base while the base itself is being molded. Alternatively, the conductive rings might be plated into previously completed slip ring bases having grooves formed therein for them. Both techniques require expensive tooling and machine operations which are now proving to be prohibitively expensive. Where the above mentioned molding process is used, expensive tooling must be provided to support and maintain the rings at the proper position as the molding process proceeds. Using those prior art techniques where plating occurs after molding, it is not unusual to find that the plating does not adhere properly to the base member. And, then, machining and replating must be occur. Losses using this process can be significant.

Commonly assigned U.S. Pat. No. 5,054,189 describes a method where a rigid annular slip ring base is molded and then grooves are machined into the outer circumferential surface of the slip ring base. The conductive material which may be in a continuous strip form is cut to a series of lengths to form conductive rings. These rings are then anchored at one end to the outer circumferential surface of the slip ring base and a rolling pressure is exerted on them around the circumference of the base to cause the rings to be press set into the grooves previously formed on the base.

All of the above prior art structures and methods of manufacturing them do not readily lend themselves to the wide variety of shapes, profiles and diameters which must now be used in connection with modern electrical slip rings. The prior art structures and methods of manufacture do not lend themselves well, for example, to linear or non circular applications. All of the prior art manufacturing methods are proving to be too expensive for the price pressures being experienced in today's market.

It is therefore an object of this invention to provide a new form of construction for electrical slip ring bases which lends itself to a variety of shapes, profiles, lengths or diameters.

Another object of this invention is to provide a electrical slip ring base assembly which is less expensive to manufacture but can maintain precise dimension while being usable in connection with the manufacture of slip rings of a variety of shapes and sizes.

A further object of this invention is to provide an electrical slip ring base structure which is of a material wherein the barriers between each of the plurality of conductive rings is such that should the brush assembly stray from its path, the brushes will not be dam aged by the barrier material.

SUMMARY OF THE INVENTION

The foregoing and other objects are achieved in a structure and method of manufacture that structure according to the invention wherein a slip ring base is constructed to have a base member of a flexible, moldable or extrudible material. Such a base member is capable of being formed into a variety of profiles or shapes allowing significant cost advantages to be achieved over prior art structures and manufacturing methods. A rigid backing or suitable hub for stiffening and reinforcing the foregoing base member is provided. Any form of conductive ring or strip may be used, i.e., flat, grooved or channeled, as well as those which may be plated to enhance the low noise conductivity characteristics of the slip ring. A means for attaching the rigid backing and the base member for mounting, varying and/or conforming the slip ring to a specified diameter is provided. The ends of the base member material can readily be fastened to form the usual annular shape.

BRIEF DESCRIPTION OF THE DRAWINGS

The principles of the invention will be most readily understood by reference to a description of preferred embodiments thereof given below in conjunction with the drawings which are briefly described as follows:

FIG. 2(*b*) is a perspective view of the FIG. 2(*a*) embodiment.

FIG. 3(*b*) is illustrative of another preferred way of placing the conductor between the barrier of the FIG. 2(*a*) embodiment.

FIG. 5(*b*) is a cross sectional view taken along the lines 5(*b*)—5(*b*) in FIG. 5(*a*).

FIG. 5(*c*) is illustrative of the construction of a slip ring base wherein the conductive channels are one step above the other in accordance with the techniques used in FIG. 5(*b*).

DETAILED DESCRIPTION OF THE PREFERRED EMBODIMENTS

Figure 1A:
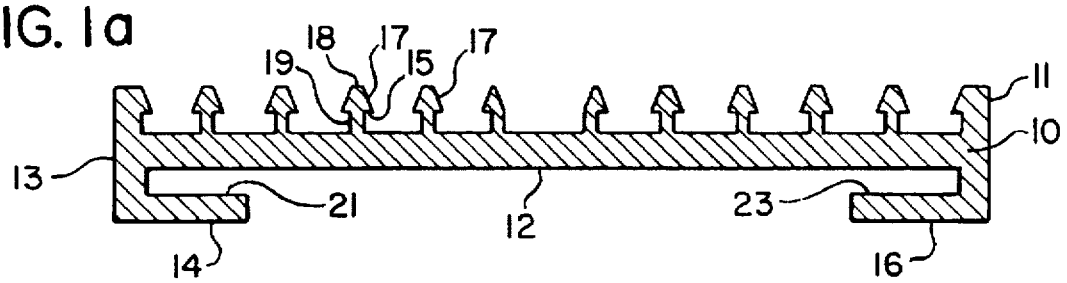
FIG. 1(*a*) through (*c*) are end cross sectional views of preferred examples of the moldable/extrudible base members according to the invention.
Figure 1B:
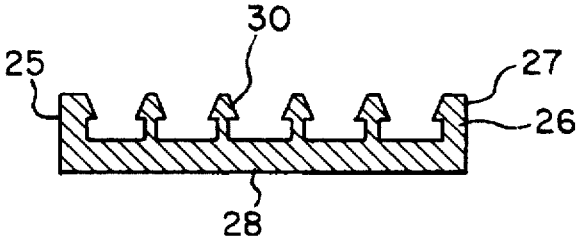
Figure 1C:
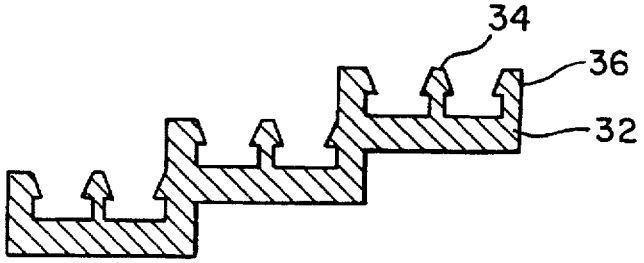

FIG. 1(*a*) is an end cross sectional view illustrating a first embodiment of a base member 10 for an electrical slip ring drawn in the shape shown from a flexible, elastomeric material. The shape, as shown, as well as the various other shapes described herein, can be molded or extruded depending on the specific material chosen. The shape or profile of the base member can readily be changed in the known manner by simply changing the mold or die or varying the extrusion process. The electrically nonconductive materials used to manufacture the elastomer base member may be of varying hardnesses (durometer rating). A flexible material is chosen to allow for flexible mounting on a suitable support or hub.

The FIG. 1(*a*) configuration includes a web portion 12 extending between vertical end members 11 and 13. Inwardly extending flange members 14 and 16 extend inwardly of the web portion from the end members to form respectively, slots 21 and 23. On the upper surface of web 12 are a series of vertical barriers 18 having shafts 19 and "arrowhead" shaped ends 17. Each of the barrier ends 17 has shoulders 15 formed thereon to receive and hold conductive strip members to be described.

FIG. 1(*b*) is a second embodiment of a base member according to the invention, manufactured in the same way and of the same materials. The base member 26 includes a flat, linear web portion 28 and end members 25 and 27 as shown. Also, included are barriers 30 of like construction as those shown in FIG. 1(*a*).

FIG. 1(*c*) is a third alternative embodiment of the slip ring base assembly base member constructed according to the same principles as the FIGS. 1(*a*) and 1(*b*) embodiments and of like materials. In this case an upwardly stepped configuration is provided for the base member 32 which also includes a series of barriers 34 and a series of end members 36 as shown. This figure is illustrative of the fact that the techniques and materials selections according to the invention provide for a wide variety of base member shapes at a very low cost.

Figure 2A:
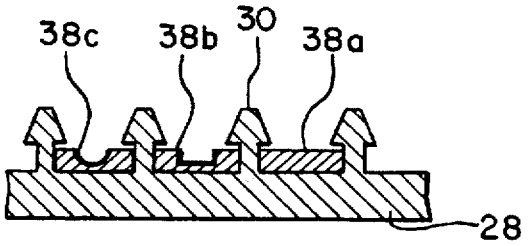
FIG. 2(*a*) is an end cross sectional view of a portion of the FIG. 1(*b*) embodiment illustrating the placement of conductor rings or strips therein.
Figure 2B:
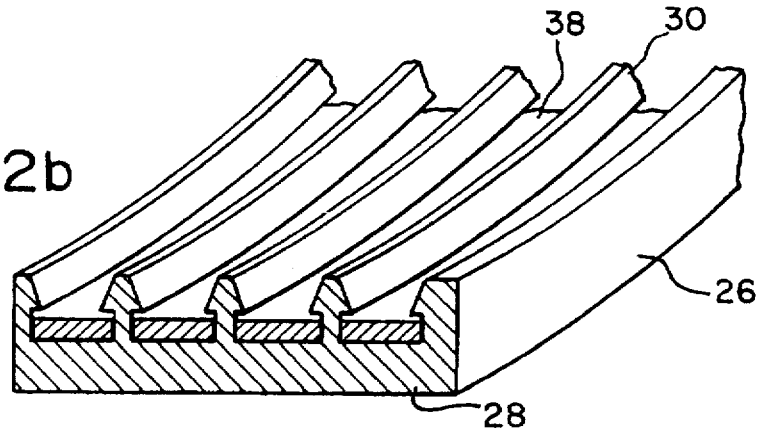

FIG. 2(*a*) is a cut away portion of the FIG. 1(*b*) embodiment (like reference numerals refer to like parts) and is illustrative of the configuration of the base member 26 when conductive strips 38 are mounted thereon. This figure illustrates a series of conductive strips 38 and illustrates the fact that the strips can be flat (38*a*), channeled (38*b*) or grooved (38*c*) as dictated by the electrical application for the slip ring.

FIG. 2(*b*) is a perspective view of the FIG. 2(*a*) embodiment wherein the base member 26 is formed into an internal drum like configuration further illustrating the arrangement of conductive strips or rings on the base member according to the invention.

Figure 3A:
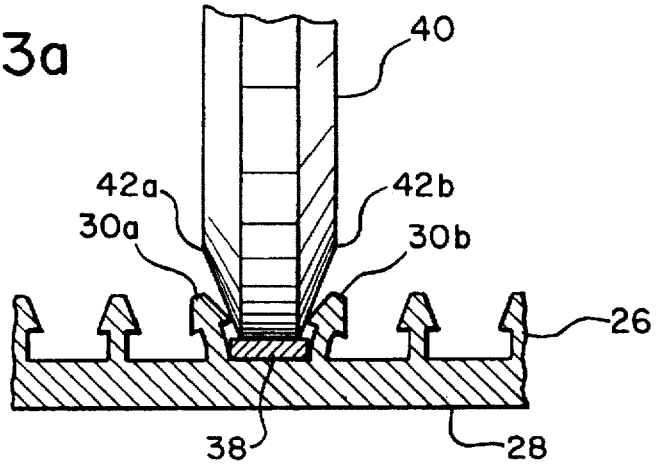
FIG. 3(*a*) is illustrative of one preferred method for placing conductive strips or rings between the barriers of the FIG. 2(*a*) embodiment.
Figure 3B:
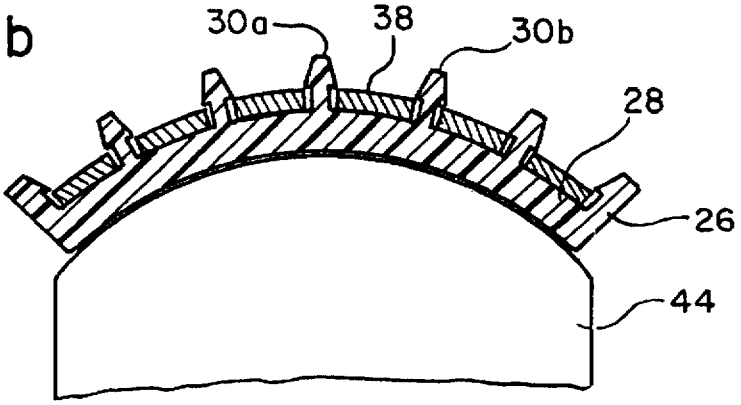

FIGS. 3(*a*) and 3(*b*) illustrate two ways for mechanically deforming the barriers on the base member to allow for insertion of a conductive strip or ring so that when the flexible base member reassumes its original shape, the conductors will be secured in place. FIG. 3(*a*) illustrates a portion of the FIG. 2(*a*) embodiment having a conductive strip 38 placed therein. Using this technique a pressure wheel 40 having tapered sides 42(*a*) and 42(*b*) is used to pressure fit the conductors on the surface of the web portion 28, in this case between barriers 30(*a*) and 30(*b*). The tapered sides 42(*a*) and 42(*b*) of the pressure wheel 40 deform the barriers 30(*a*) and 30(*b*) to force the conductor 30(*a*) between them and when the pressure wheel leaves the space between barrier 30(*a*) and 30(*b*) they resume their upright positions so that their respective shoulders holds the conductor 38 in place. In FIG. 3(*b*) a differing technique for spreading the barriers is shown. Again, the FIG. 2(*a*) embodiment is used as an example. In this case, the base member 26 is laterally wrapped around the arcuate portion of hub-like member 44 so that, for example, the barriers 30(*a*) and 30(*b*) are spread to allow the insertion of a conductive strip or ring, such as 38. When the base member 26 is removed from the hub 44, the barriers return to their original positions with the shoulders thereof securing the conductors in place.

Figure 4:
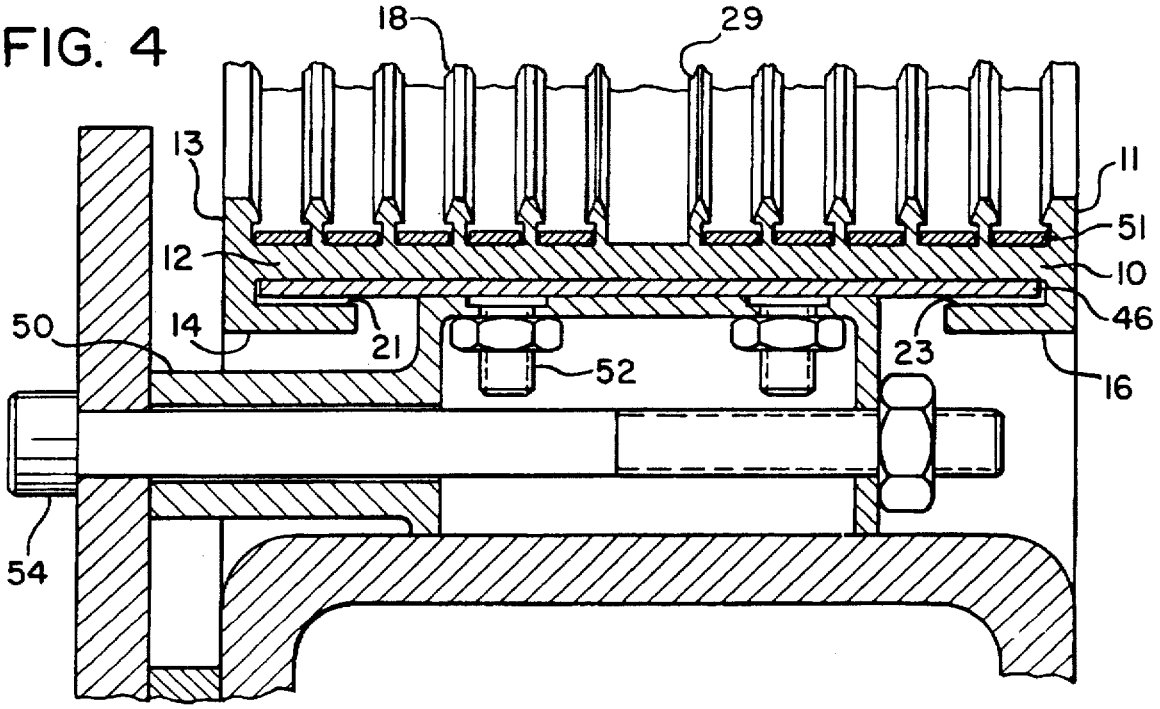
FIG. 4 is a side partial cross sectional view of an illustrative example of a rotating assembly having the electrical slip ring base assembly according to the invention mounted thereon.

FIG. 4 illustrates an application of the FIG. 1(*a*) base member embodiment on a rotating slip ring base assembly. The numerals used in FIG. 1(*b*) apply to the same elements in FIG. 4.

Since the material used to form base member 10 is flexible, it may not hold a stable shape. Accordingly, a rigid backing must be used or it must be fitted over a suitable hub. In the case of the FIG. 1(*a*) embodiment of a base member according to the invention, slots 21 and 23 are provided to receive a flat linear and more rigid backing member 46. As shown, the backing member is placed into the base member on a side opposite that of the conductor strip 51. The material used for the backing member can be any material which will provide adequate rigidity while still maintaining a certain amount of necessary flexure for the assembly. Furthermore, the cross section of the material must be thin enough to allow for flexure without imposing undue stresses on the inner and outer surfaces of backing 46 as to cause permanent plastic deformation or in the long term, "creep damage". The base member, conducting strips and backing member, when so assembled, constitute an electric slip ring base assembly according to the invention.

The foregoing base assembly in FIG. 4 is mounted on a rotating hub 50 and secured thereto by support mounting bolts 52. A shaft connection 54 is provided, as shown. As the hub 50 rotates, conductive brushes (not shown) of conventional construction will engage the plurality of conductors 51 to communicate electrical signals between the rotating assembly and the brushes. As discussed in connection with FIG. 1(*b*), groove 29 is provided in this case for a guide wheel which will have the effect of keeping the brushes "on track" between the barriers 18. Of particular interest, however, is the fact that should the brushes be allowed to stray from the centers of the conductive strips 51, they will not be damaged by the barriers 18 because these barriers are of a flexible elastomeric material, and are non-abrasive.

Figure 5A:
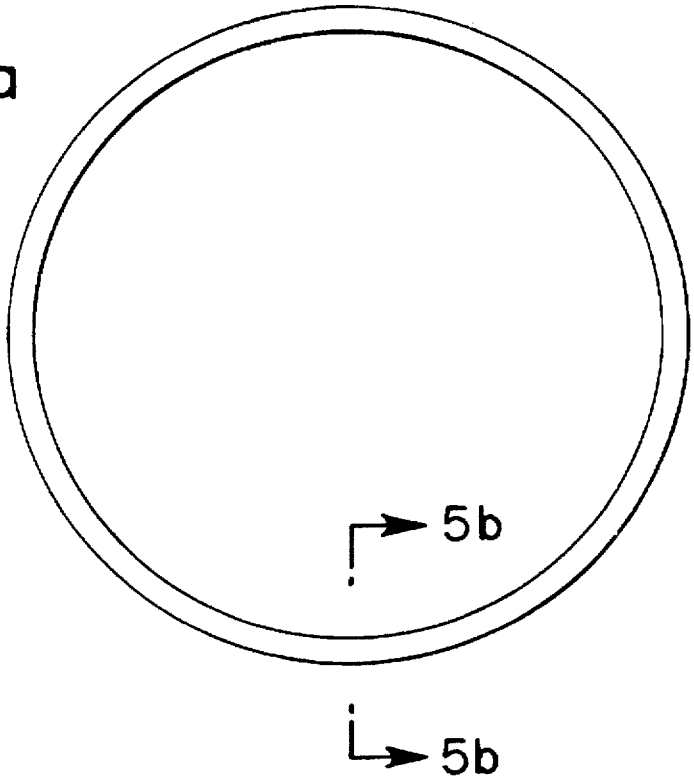
FIG. 5(*a*) is a simple schematic representation of the FIG. 1(*a*) embodiment formed as an annular slip ring base.
Figure 5B:
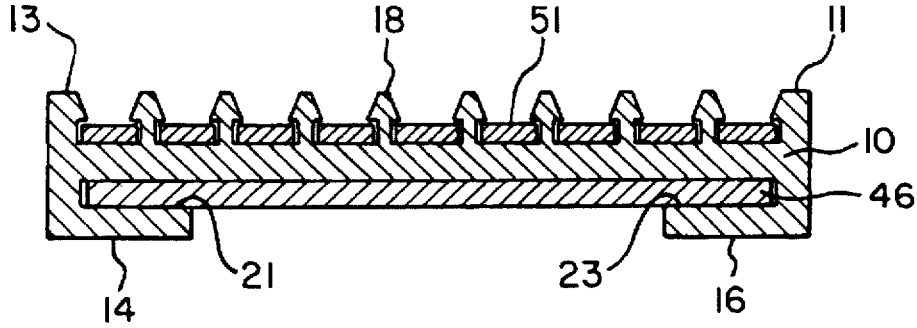
Figure 5C:
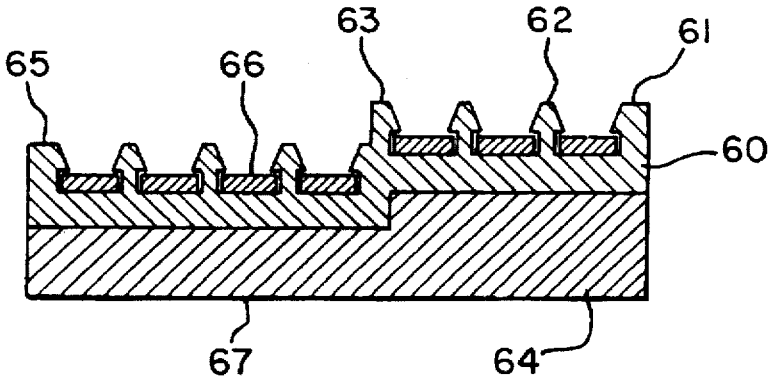

FIG. 5(*b*) is a cross section taken along the lines 5(*b*)—5(*b*) in FIG. 5(*a*). FIG. 5(*a*) simply illustrates schematically the use of the FIG. 1(*a*) embodiment in an annular slip ring configuration. FIG. 5(*b*) in cross sectional form more clearly indicates the arrangement of this FIG. 1(*a*) embodiment with the rigid backing in place. FIG. 5(*c*) illustrates the construction of a stepped base member 60 having portions thereof 61, 63 and 65 formed as end members as shown. This embodiment also includes a series of barriers 62 formed as shown in connection with other embodiments herein. This embodiment is shown with the series of conductor 66 in place. As in FIG. 4 and 5(*b*) a rigid backing 64 having a flat outer surface 67 is provided. This demonstrates that in those applications where a stepped brush arrangement is necessary, the principles of the invention can be utilized to form a base assembly capable of, for example, being mounted on a flat hub arrangement as shown in FIG. 4. This demonstrates the versatility of the invention in providing base member of a variety of different shapes but which are able to accommodate conventional rotating mechanisms.

Figure 6:
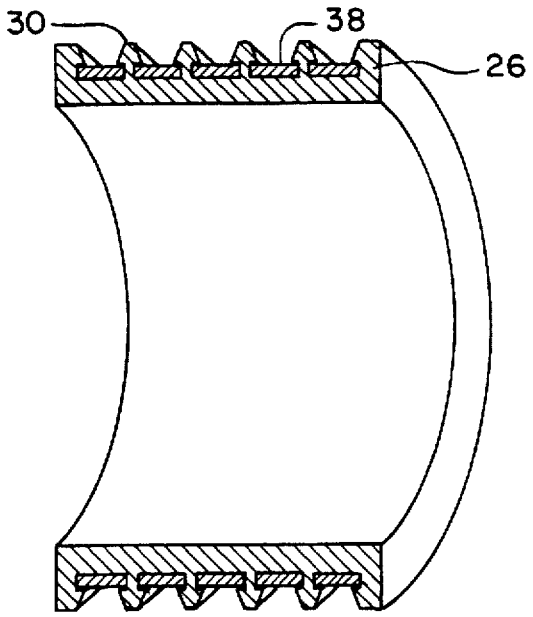
FIG. 6 is a cross sectional, perspective view of the FIG. 1(*b*) base member embodiment formed in an external drum arrangement.
Figure 7:
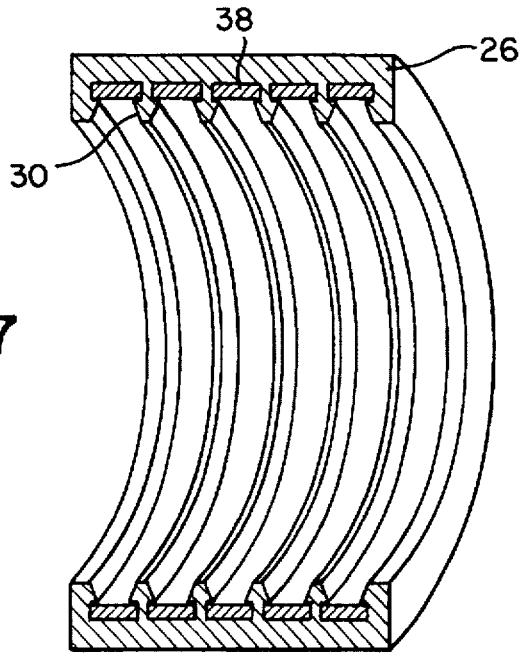
FIG. 7 is a cross section, perspective view of the FIG. 1(*b*) embodiment formed into an internal drum arrangement.
Figure 8:
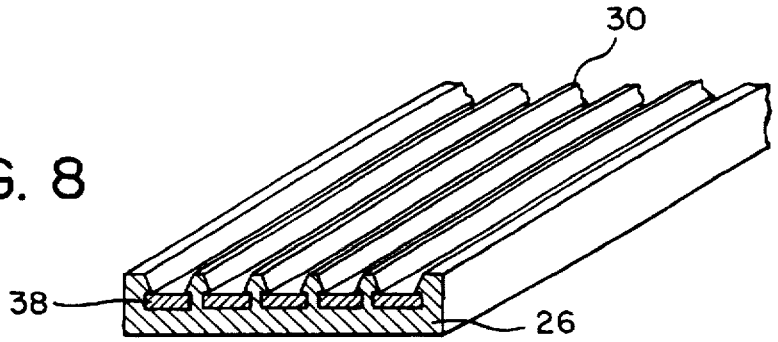
FIG. 8 is a cross sectional perspective view of the FIG. 1(*b*) embodiment in a linear arrangement.

FIGS. 6 through 8 illustrate in partial perspective view the use of the FIG. 1(*b*) embodiment, to a embodiment in a variety of configurations. FIG. 6 illustrates the FIG. 1(*b*) base member shown for use in an external drum arrangement, FIG. 7 uses the same embodiment in an internal drum arrangement and FIG. 8 illustrates a simple linear application.

The conductor rings or strips for the slip rings using the base member according to the invention can be flat, grooved or channeled. Bare conducting material can be used, as can plated material for better conduction and electrical noise characteristics. The rings should be of sufficient current carrying capacity for the application to which they are applied. Ring thickness, width and length are determined by the current carrying capacity needed, and the dimensions of the base member, such as barrier height, distance between barriers and web thickness can be determined by operating voltage accordingly. The ends of the conductor rings may be fitted with studs for attaching wiring which may fit into a termination bracket to which external wiring may be connected.

While the base member with backing in place is shown in FIG. 4 as being mounted on a rotating hub assembly, other supports may be used. Any variety of support members suitable to the mechanical purpose can be selected.

It is envisioned that an assembly of conductive brushes of known construction are to be used for transmitting power and/or signals from, in this example, the rotating slip ring base assembly to a stationary location. The brush block assembly may use a tension arm for holding the brushes in contact with the conductor strips, and if a sufficient number of conductor strips are present, as in the FIG. 4 embodiment, a guide wheel may be used to ensure that the brushes make maximum contact with the conductor strips or rings.

The principles of this invention have been described herein above by describing a number of preferred embodiments. It is to be understood that the described embodiments can be modified or changed while remaining within the scope of the invention as defined by the appended claims.

We claim:

1. A method of manufacturing an electrical slip ring base assembly, comprising the steps of:

forming a base member, having a first surface for receiving at least one conductive strip and a second surface for receiving a backing member, by one of a molding or extruding process from a flexible, electrically non-conductive material;

securing said at least one conductive strip to said first surface of said base member; and mounting said backing member on said second surface of said base member for rigidly supporting said base member in a predetermined shape.

2. The method described in claim 1 wherein said flexible, nonconductive material is an elastomeric material.

3. The method described in claim 1 wherein said slip ring base assembly is of a generally circular shape and said means for carrying the conductive strip extends circumferentially therearound, and wherein said forming step includes cutting said base member to length corresponding to a predetermined diameter for the slip ring base assembly and attaching the ends of the cut base member one to the other.

4. A method of manufacturing an electrical slip ring base assembly as claimed in claim 1, wherein said forming step comprises forming said base member such that said first surface includes a plurality of barriers of said flexible material, and said securing step comprises securing a plurality of said conductive strips to said first surface such that each of said conductive strips is located between two of said barriers.

5. A method of manufacturing an electrical slip ring base assembly as claimed in claim 1, wherein said mounting step comprises applying an adhesive layer between said backing member and said second side of said base member.

6. An electrical slip ring base assembly, comprising:

a base member of flexible, electrically non-conductive material capable of being one of molded or extruded, said base member having a first surface for receiving electrically conductive strips and an opposing second surface for receiving a backing member;

at least one electrically conductive strip secured to said first surface of said base member; and a backing member mounted on said second surface of said base member for supporting said base member, said backing member being of a material which is rigid relative to said flexible material.

7. The electrical slip ring base assembly described in claim 6 further comprising a plurality of said conductive strips which are electrically separated, and wherein said base member is formed to include a plurality of nonconductive barriers of said flexible material interposed between adjacent ones of said conductive strips.

8. The electrical slip ring base assembly described in claim 6 wherein said backing member is secured by an adhesive to said second surface of said base member.

9. A method of manufacturing an electrical slip ring base assembly having a generally circular shape, comprising the steps of:

forming a base member, including a means extending circumferentially around said base member for carrying at least one conductive strip, by one of a molding or extruding process from a flexible, electrically non-conductive material, wherein said base member is cut to a length corresponding to a predetermined diameter of said base assembly and the ends of said base member are attached one to the other;

securing said at least one conductive strip to a first surface of said base member; and mounting a backing member on a second surface of said base member for rigidly supporting said base member in said generally circular shape.

* * * * *